United States Patent [19]

Herzner

[11] 3,981,645

[45] Sept. 21, 1976

[54] DISPLACED PISTON MACHINE

[76] Inventor: Hans Herzner, 3579 Schrecksbach/Holzburg, Eichmuhle, Germany

[22] Filed: Aug. 1, 1974

[21] Appl. No.: 493,929

[52] U.S. Cl. ..... 418/161; 418/164

[51] Int. Cl.[2] ..... F04C 17/18

[58] Field of Search ..... 418/58, 68, 161, 164

[56] References Cited

UNITED STATES PATENTS

| | | | |
|---|---|---|---|
| 1,887,884 | 11/1932 | Eyston | 418/161 X |

FOREIGN PATENTS OR APPLICATIONS

| | | | |
|---|---|---|---|
| 1,000,029 | 1/1957 | Germany | 418/161 |
| 1,921,454 | 11/1970 | Germany | 418/161 |
| 640,937 | 3/1935 | Germany | 418/161 |

*Primary Examiner*—C. J. Husar
*Assistant Examiner*—Leonard Smith
*Attorney, Agent, or Firm*—Hill, Gross, Simpson, Van Santen, Steadman, Chiara & Simpson

[57] ABSTRACT

A displaced piston engine which has at least one piston received between two guide members in a cylinder, the guide members having opposed guide surfaces contacting surfaces of the piston, the contacting surfaces of the piston and guide members being arcuately, coaxially curved, the guide members being coupled together in their relative oscillatory movement in the cylinder in dependent relationship to the stroke of the piston within the cylinder, and at least one of the guide members being attached directly or indirectly to a shaft for rotation therewith.

11 Claims, 8 Drawing Figures

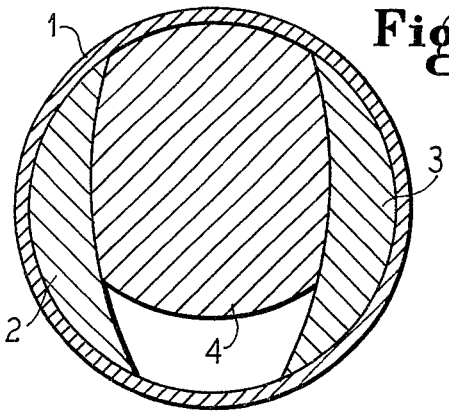
Fig. 1
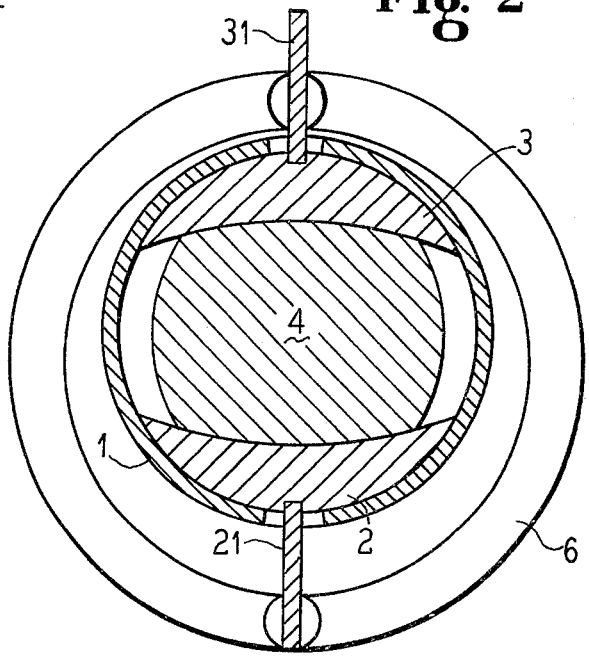
Fig. 2
Fig. 3
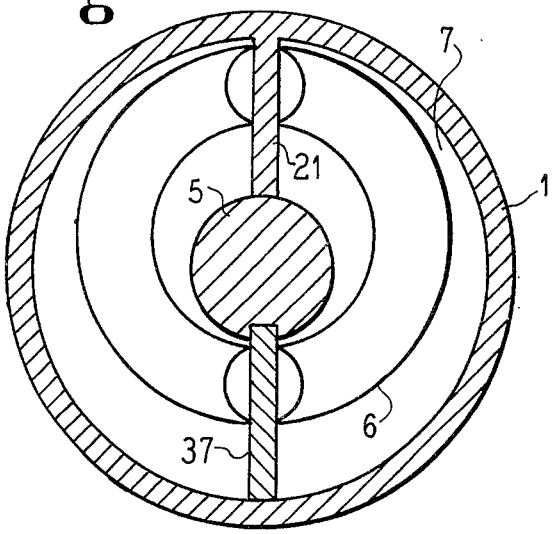
Fig. 4
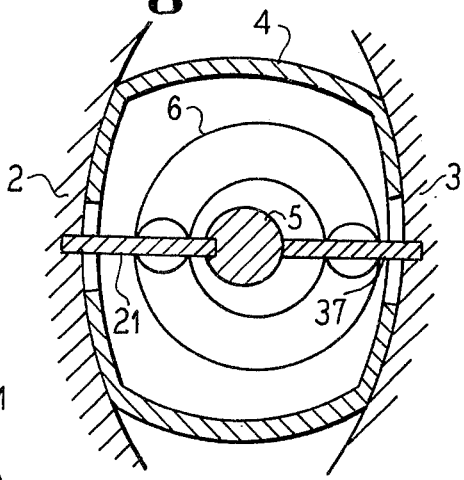
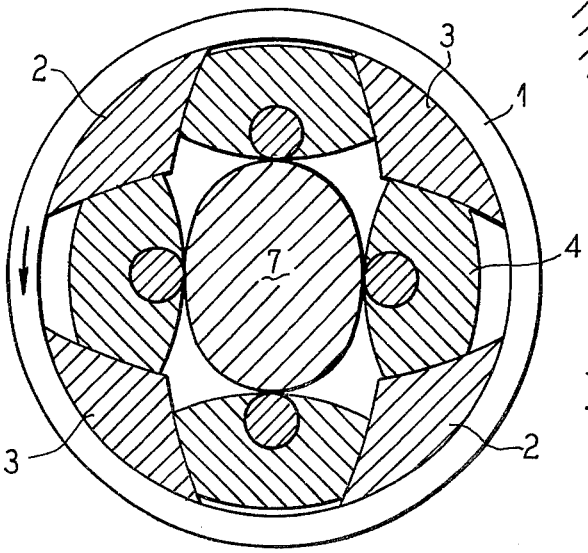
Fig. 5

DISPLACED PISTON MACHINE

BACKGROUND OF THE INVENTION

1. Field of the Invention

This invention relates to pumps and motors and more particularly to a rotating engine having a reciprocating piston received between guide members in a casing or cylinder.

2. Prior Art

Displaced piston engines of the type to which this invention relates comprise a rotor rotating in a cylindrical casing or cylinder. The working chamber is defined by guide surfaces on the rotor, the inside wall of the casing, and the end faces of a displaceable double ended piston received between the guide surfaces and which is actuated by or displaces a working medium within the working chambers at right angles to the axis of rotation.

Machines of this type are described, for example, in German Pat. No. 640,937 and in the German Offenlegungsschrift No. 1,451,742. In machines of the type described in those references, the displacement movement of the double acting piston is transmitted without a connecting rod by a crank which is connected to the shaft, in one instance, by an eccentric mount and in the other instance, by a central mount. In those instances where an eccentric shaft is used, the crank is attached to a bearing pin which is seated in the piston. In the case of central shaft mounting machines, it is necessary to provide a slide block which can be shifted cross-wise or transversely of the piston to provide a seat for the crank-pin bearing.

It is an object of the present invention to transform the displacement movement of the piston into a rotary movement directly without the use of a crank in the case of a central shaft support and with the added possibility of varying the piston stroke as required and the further possibility of providing a plurality of pistons in a star arrangement.

To this end, according to the present invention, the guide surfaces which are part of the rotor and which limit the working chamber are provided as surfaces of two separate guide members. Further, the contacting surfaces of the guide members and of the piston are arcuately curved coaxially in such a manner that the guide members are coupled together in their oscillatory movement in the casing in dependent relation to the piston stroke. One of the guide members is firmly attached to the shaft for rotation therewith or to an intermediate part which is itself firmly attached to the shaft for rotation therewith.

In such a construction, the displacement movement of the piston causes the guide members to move about the axis of rotation as a result of a cam thrust exerted on them by movement of the piston. This movement about the axis of rotation can then be transmited directly to the shaft because one of the guide members is connected to the shaft. The coupling of the guide members effectively limits the stroke of the piston, which operates, in effect, as a free piston. This being the case, there is a wedge effect to some extent which insures the maintenance of an effective seal between the piston and the guide members.

The curvature of the two piston surfaces and the guide members is important, however, they may be curved convexly or concavely so long as the curvature is one of equal radii. However, it is kinematically more effective if the piston surfaces are curved convexly and the guide surfaces of the guide members are curved correspondingly concave. In such a case, the guide members have a sickle-shape in the basic embodiment when only one displaceable piston is disposed in the rotor.

The coupling together of the two guide members may be accomplished in numerous ways. Primarily, this invention teaches guide members which engage a control ring which is mounted eccentrically of the axis of rotation and which is able to rotate. The guide members and the control ring engage one another via a plate-shaped intermediate element which is mounted for rotary oscillation in the guide member or in the control ring, the intermediate elements being radially or substantially radially slidable in one of the two.

According to the present invention, three types of arrangements are provided for the control ring. In the first, the control ring is mounted at the periphery of the machine having a rotating casing, and one of the guide members is connected rigidly to the casing while the other is slidable on the casing, an opening in th casing allowing oscillatory movement of the intermediate member which is provided between the control ring and the guide member slidable on the casing.

In the second arrangement, the control ring is mounted laterally, one of the guide members is disposed rigidly on the rotating casing and one intermediate element is disposed rigidly thereon while the other guide member is disposed rigidly on one rotating end wall and the intermediate element associated therewith is disposed rigidly thereon. The first intermediate element is slidably guided at its free end on the shaft which is connected to the end wall so as to rotate therewith, while the free end of the second intermediate element is guided slidably on the laterally projecting casing.

The third solution provides a very compact construction with a stationary casing and stationary end walls. The control ring is disposed inside a hollow piston, which is formed with apertures for the intermediate elements and for a hollow journalling of the control ring. One of the intermediate elements forms a rotationally rigid connection between one guide member and the shaft which passes through the piston and which also forms the control ring.

In all three cases, in the development of the invention, the sickle-shaped chamber or chambers defined by the control ring and central machine parts, such as the casing, shaft, and housing ring, serve as additional working chambers in which the intermediate elements rotate as power members.

Such devices are versatile, for example, an arrangement according to the third embodiment may be used as a coolant or lubricant pump, while the first two embodiments lead to a combination of rotary displaced piston and rotary valve piston engines.

In an important improvement, the control ring bearing is made adjustable so as to allow adjustment of the control ring eccentricity which in turn controls the piston stroke. In this way it is possible to use such devices as a fluid clutch or brake.

Additionally, the gude members can be coupled together by a transmission comprising elliptical or eccentric spur gears or by an anti-parallel crank drive and a countershaft.

Where the machine is constructed as a twin or tandem machine comprising two pistons, one piston is utilized to carry out the first and second stroke while the other piston carries out the third and fourth stroke in the four stroke machine. While such a division is known in other machines, it has not been used in the case of a rotary piston machine operating practically with free pistons.

In comparison with previously known machines, it is now possible to dispose a plurality of displaced pistons in the rotor in the form of a star. In this case the guide members have a symmetrical shape in keeping with the previously discussed embodiment and each of them is associated with two displaceable pistons. The guide members are then alternately disposed free and rigidly connected to a rotating housing part, i.e., the rotating casing, in the direction of rotation and the movement of the pistons is controlled by an elliptical or eccentric cam shaft.

In another modification, in the direction or rotation, the guide members are alternately connected to a rotating housing part so as to rotate therewith and to the shaft so as to rotate therewith, and one group of guide members is connected to the other group in the manner described hereinbefore, i.e., by a control ring or a transmission.

There is a further possiblity of obtaining additional working chambers in the case of a rotating casing by providing, across the circumference or in each part of the periphery of the casing which is continuously covered by a guide member not connected to the casing, any abrupt enlarged radius in comparison with the cylindrical member. The resulting curved chamber can form the working space of a plate shaped radial power member rigidly connected to the guide member. This power member can then perform the same oscillating movement as the guide part.

In dimensioning the radius of curvature of the contact surfaces between the piston and guide members, attention must be paid to the geometry of movement of the pistons and guide members and also to the fact that the piston surfaces act as thrust cams. As a rule of thumb, it may be stated that the radius of curvature in the case of a singlely divided cylindrical member should be at least equal to the casing diameter, while in the case of a multi-divided cylindrical member, i.e., the star arrangement of this invention, it should be at least equal to the casing radius. In the first case, a ratio of 1:1 to 3:2 between the radius of curvature of the contact surfaces and the casing diameter and in the second instance, a ratio of 2:1 between the radius of curvature in the casing radius has proven to be advantageous, since it permits a relatively large piston stroke while retaining sufficient thrust effect.

Control of the working medium depends upon the purpose of use, and as far as possible the relative movement between the two individual or the two types of guide members will be used for control purposes. The piston or pistons operating as free pistons are also suitable for controlling purposes.

BRIEF DESCRIPTION OF THE DRAWINGS

Other objects, features and advantages of the present invention will be readily apparent from the following description of the preferred embodiments thereof taken in conjunction with the accompanying drawings although variations and modifications may be effected without department from the spirit and scope of the novel concept of the disclosures.

FIG. 1 is a cross sectional view at right angles to the axis of rotation through a machine having a single displaced piston;

FIG. 2 illustrates the machine of FIG. 1 in a different piston position and with a control ring added;

FIG. 3 is a cross sectional view at right angles to the axis of rotation through a lateral control ring arrangement;

FIG. 4 is a sectional view of a modified form of the machine of this invention; and FIG. 5 is a sectional view of a star arrangement of the displaced piston engine of this invention.

DESCRIPTION OF THE PREFERRED EMBODIMENTS

Figure 6:
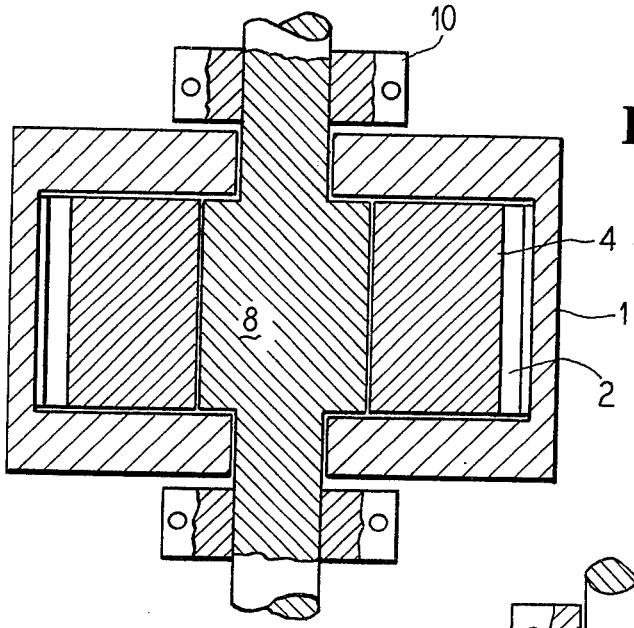
FIG. 6 is a horizontal diametrical simplified sectional view of the embodiment of FIG. 5.

As illustrated in FIG. 1, a cylindrical member rotating in a cylindrical casing or cylinder 1 includes two relatively identical guide members 2 and 3 between which is positioned a double acting piston 4. The contact surfaces between the piston 4 and the guide members 2 and 3 are each curved arcuately in the same way, the piston surfaces being convex and the guide surfaces being correspondingly concave.

If the piston 4 moves downward from the top dead center position illustrated in FIG. 1, the guide member 2 carries out a rotary movement in a clockwise direction and the guide member 3 a rotary movement in the anit-clockwise direction.

As is apparent from FIG. 2, the guide members 2 and 3 are interconnected or coupled by an eccentrically mounted control ring 6 in such a way that a complete piston stroke takes place during half a revolution of the cylindrical member. In addition, the coupling of the guide members 2 and 3 defines the top and bottom dead center positions of the piston 4. Since one of the two guide members 2 or 3 is connected to the central shaft, not shown, so as to rotate therewith, for example, by way of the casing 1 which rotates in this case, and/or a rotating end wall, the piston movement is transmitted to the shaft without the use of a crank and connecting rod. That is to say the piston 4 is itself part of a cam drive to the shaft. The radius of curvature of the contact surfaces of the piston 4 in the guide members 2 and 3 is about 1.25 times the casing diameter in the simple example illustrated in FIGS. 1 and 2.

The coupling between the guide members 2 and 3 and the common control ring is carried out by intermediate members 21 and 37 or 31 which, on the one hand are rigidly connected to the guide members 2 and 3, and on the other hand, are operatively connected to the control ring in a manner which allows them to be rotatably oscillated. As an alternate method to that illustrated, the intermediate members 21 and 37 or 31 may be in operative engagement with the guide members 2 and 3 and rigidly connected to the control ring 6. An opening in the casing 1 permits the oscillating movement of the intermediate member 31.

When the control ring 6 is disposed laterally, as is graphically illustrated in FIG. 3, the guide member 2 must be imagined as being disposed rigidly on the rotating case 1 and the guide member 3 on the likewise rotating end wall 7. Since the latter is in turn connected to the shaft 5 so as to rotate therewith, the intermediate element 31 or 37 can engage the shaft 5 directly so as to rotate therewith. There is also a rigid connection between the casing 1 and the intermediate element 21 so that they rotate as power members in the sickle-shaped chambers which are defined, on the one hand, by the control ring 6 and on the other hand, by the overlying casing or cylinder 1 and the shaft 5 and which can therefore be used as additional working chambers.

FIG. 4 illustrates substantially the same type of construction, however, wherein a hollow piston 4 is provided with a control ring 6 positioned interiorly thereof, as is the shaft and the intermediate members 21 and 31.

FIG. 5 illustrates a star-shaped arrangement utilizing a plurality of pistons 4. The guide members 2, in this example, are firmly connected with the rotating casing or cylinder 1, while the guide parts 3 are free and coupled to the guide members 2 via the pistons 4 which bear on a non-rotating elliptical member 7 against the working pressure. Rollers (not numbered) can serve to support the pistons 4. The elliptical member 7 may also be replaced by an elliptical cam track in an end wall. The ratio between the radius of curvature of the contact surfaces and the casing radius is given the extreme value of 2.5:1 in the example illustrated. That is to say it corresponds to the radius ratio illustrated in FIGS. 1 and 2.

Figure 7:
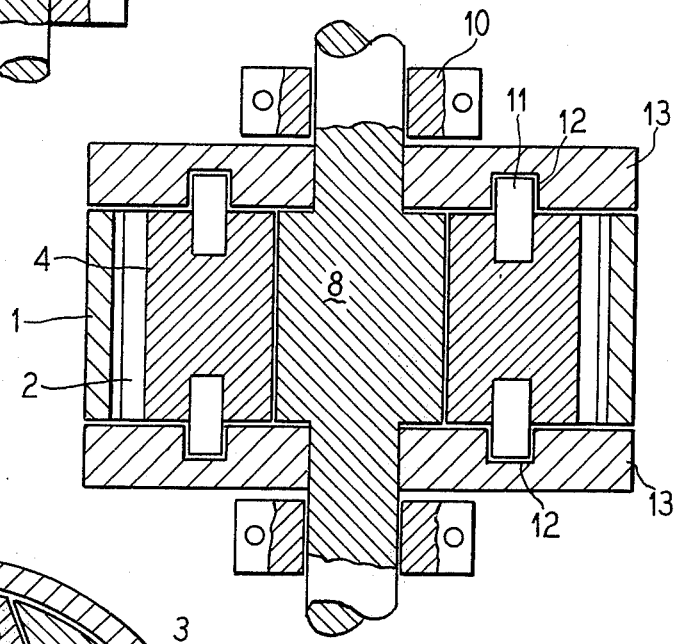
FIG. 7 is a view similar to FIG. 6 illustrating the described modification thereof.
Figure 8:
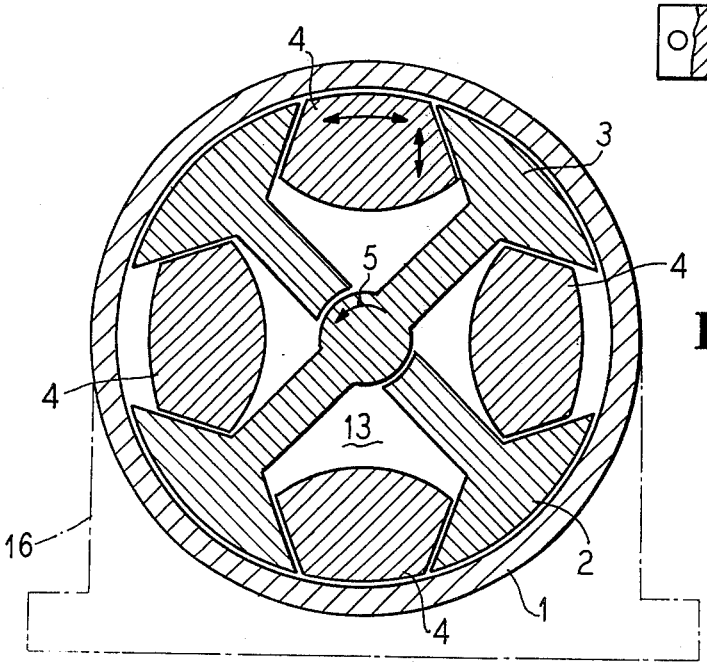
FIG. 8 is a sectional view similar to FIG. 5 illustrating another embodiment of the machine of this invention.

FIGS. 6, 7 and 8 show various modifications of the above-described machine illustrating how different connections can be accomplished. In FIG. 6, which is a simplified cross-sectional view of the embodiment of FIG. 5, the non-rotating elliptical member, now numbered 8, is received in a non-rotating fashion in mounting blocks 10. Since the member 8 is held against rotation, and since there is no connection holding the cylinder 1, the cylinder 1 will rotate under the influence of the pistons 4 acting against the outer diameter of the member 8 and against the guide parts 2 which are firmly connected to the cylinder 1.

FIG. 7 is a view similar to FIG. 6 showing the use of the rotating elliptical member 8 which is freely received through mounting blocks 10. In this embodiment, guide pins 11 are received in approximately elliptical grooves 12 in side walls 13. This embodiment may have the following combinations: the casing 1 and two opposed guide members 2 which are attached fixedly to the casing, are held stationary, in which event the side walls 13 and the body member 8 rotate synchronously; the casing 1 is allowed to rotate and the side walls and body 8 are held stationary; or, as best illustrated in FIG. 8, the guide members 3 are fixedly attached to the shaft 5, all of the pistons 4 are guided in grooves similar to the grooves 12 of FIG. 7 in the side walls 13, the side walls are held stationary as by attachment to a mounting block 16 and all of the guide members 2 and 3 are allowed to rotate with respect to the casing 1. In this embodiment the shaft 5 rotates and would therefore be received freely in a mounting block such as that illustrated at 10 in FIG. 7.

It can therefore be seen from the above that my invention discloses a displaced piston engine, i.e., a reciprocating substantially free piston engine, which includes a rotating assembly consisting of a oscillating piston and guide surfaces rotatably received in a casing or cylinder. The working chambers are defined between the guide members and the piston and the casing or cylinder wall and the gude members are coupled together for movement in dependent relation to the position of the piston which is acted upon or acts upon a working medium. Specifically, the contacting surfaces of the piston and guide members are arcuately coaxially curved, with one of the guide members in each set of guide members being rigidly, torsionally connected to a shaft for rotation therewith.

Although the teachings of my invention have herein been discussed with reference to specific theories and embodiments, it is to be understood that these are by way of illustration only and that others may wish to utilize my invention in different designs or applications.

I claim as my invention:

1. A moving piston machine comprising: at least one piston received in a housing, at least one working chamber in said housing defined in part by a wall of the housing, an end face of the piston and opposed walls of a pair of guide members per piston, the guide members received in said housing, at least one of the guide members free to oscillate in the housing, the opposed walls of the guide members contacting opposite side walls of the piston, each of the opposed walls of the guide members and its contacted wall of the piston being coaxially arcuately curved, movement of the piston varying the size of the working chamber and moving at least one contacted guide member within the housing, and a guide member of each pair being firmly connected to a rotatable shaft means in a nonrelatively rotatable manner, the piston moving at a right angle to the rotation of the shaft means.

2. The machine of claim 1 wherein the housing is a rotatable cylindrical casing to which one guide member of each pair is firmly connected, the casing being eccentrically surrounded by a rotatable control ring and coupled to said control ring through a connection providing oscillating movement of the connection with one of the control ring or casing, and the other guide member of the pair of guide members being indirectly coupled to the control ring by a connection allowing oscillation therebetween.

3. A displaced piston engine comprising a rotating assembly having in a casing, at least one working chamber defined by guide surfaces of the assembly, the casing and the opposed faces of at least one piston received in the casing which is acted upon by a working medium in the chamber at a right angle to the axis of rotation, the guide surfaces defining the chamber being defined by walls of at least one set of two separated guide members, the guide surfaces contacting surfaces of the piston and the contacting surfaces of the piston and guide members being arcuately, coaxially curved, the guide members in each set being coupled in their relative oscillatory movement in the casing and such movement being in dependent relation to the stroke of the piston and one of the guide members in each set being firmly connected to a shaft and rotatable therewith.

4. An engine as defined in claim 3 wherein the contacting surfaces of the piston have convex curvatures to the same radii.

5. The engine as defined in claim 4 in which the guide members engage a control ring which is mounted eccentrically of the axis of rotation of the assembly and which is adapted to rotate.

6. The engine as defined in claim 5 in which the guide members and the control ring engage one another through an intermediate element respectively mounted for rotary oscillation in one of the guide member and the control ring, the intermediate elements respectively being substantially radially slidable in one of a guide member and control ring.

7. The engine as defined in claim 6 wherein the control ring is mounted at the periphery of the engine, the engine including a rotating casing, and one of said guide members is disposed rigidly on the casing while another of said guide members is slidable on the casing, the casing having an opening with the intermediate member extending therethrough and the opening means sufficiently large to allow oscillatory movement of the intermediate member.

8. An engine as defined in claim 6 wherein the control ring is mounted laterally, one of the guide members is disposed rigidly on the rotating casing and an intermediate member is disposed rigidly thereon, while another guide member is disposed rigidly on a rotating end wall and an intermediate element is disposed rigidly thereon, the intermediate element being slidably guided at a remote end on a shaft which is connected to the end wall so as to rotate therewith.

9. An engine as defined in claim 6 in which the control ring is disposed inside a hollow piston which is formed with apertures for the intermediate elements, one of said intermediate elements forming a rotationally rigid connection between a guide member exterior of the piston and a shaft passing through the piston.

10. An engine as claimed in claim 4 which comprises a plurality of displaced pistons disposed in a star formation interior of the casing, a plurality of guide members having symmetrical shapes, each of said guide members contacting two displaced pistons.

11. An engine as claimed in claim 10 in which the guide members are connected to a rotating housing part and rotatable therewith, the guide members being loose and the movement of the displaced piston controlled by a cam track.

* * * * *